US005685402A

United States Patent [19]

Lin

[11] Patent Number: 5,685,402

[45] Date of Patent: *Nov. 11, 1997

[54] INTERNAL FRAME FOR A WHEELED SUITCASE

[76] Inventor: Jerhong Lin, 7548 Donegal Dr., Cupertino, Calif. 95014

[ * ] Notice: The portion of the term of this patent subsequent to Mar. 27, 2015, has been disclaimed.

[21] Appl. No.: 492,586

[22] Filed: Jun. 20, 1995

Related U.S. Application Data

[63] Continuation-in-part of Ser. No. 409,837, Mar. 27, 1995, Pat. No. 5,560,459, which is a continuation-in-part of Ser. No. 371,401, Jan. 1, 1995, Pat. No. 5,588,512.

[51] Int. Cl.[6] ..... A45C 5/14; A45C 13/04; A45C 13/26; A45C 13/36

[52] U.S. Cl. ..... 190/115; 190/18 A; 190/39; 190/127; 190/18 R; 190/24

[58] Field of Search ..... 190/24, 122, 124, 190/125, 127, 115, 39, 18 R, 18 A; 16/115

[56] References Cited

U.S. PATENT DOCUMENTS

| | | | |
|---|---|---|---|
| 627,374 | 6/1899 | Wood | 190/122 X |
| 1,001,563 | 8/1911 | Spiro | 190/127 |
| 2,755,896 | 7/1956 | Breglia | 190/115 |
| 4,433,760 | 2/1984 | Pelavin | 190/127 X |
| 4,759,431 | 7/1988 | King et al. | 190/18 A |
| 4,890,705 | 1/1990 | Pineda | 190/18 A |
| 4,995,487 | 2/1991 | Plath | 190/18 A |
| 5,167,306 | 12/1992 | Carrigan, Jr. | 190/18 A |
| 5,181,590 | 1/1993 | Carpenter et al. | 190/115 X |
| 5,197,579 | 3/1993 | Bieber et al. | 190/115 X |
| 5,253,739 | 10/1993 | King | 190/18 A |
| 5,295,565 | 3/1994 | Latshaw | 190/18 A |
| 5,330,037 | 7/1994 | Wang | 190/18 A |
| 5,350,046 | 9/1994 | Falloon et al. | 190/127 X |
| 5,431,262 | 7/1995 | Rekuc et al. | 190/127 X |
| 5,435,423 | 7/1995 | Rekuc et al. | 190/115 X |
| 5,476,163 | 12/1995 | Wu | 190/115 |
| 5,560,459 | 10/1996 | Lin | 190/127 X |

FOREIGN PATENT DOCUMENTS

| | | | |
|---|---|---|---|
| 702097 | 1/1965 | Canada | 190/115 |
| 986708 | 8/1951 | France | 190/127 |
| 1198020 | 8/1965 | Germany | 190/115 |

*Primary Examiner*—Sue A. Weaver
*Attorney, Agent, or Firm*—The Kline Law Firm, P.C.

[57] ABSTRACT

An internal frame for supporting a substantially rectangular wheeled suitcase comprises:

(1) a base;

(2) a U-shaped frame having a top panel and two side panels, the lower ends of the two side panels being vertically mounted to the left and right sides of the base;

(3) a substantially rectangular extension board wherein the approximately middle section of the extension board is mounted to the top panel of the U-shaped frame;

(4) two L-shaped braces mounted on the rear end of the extension board;

(5) two supporting tubes vertically mounted on the rear side of the base;

(6) two L-shaped head covers mounted on the rear sides of the two L-shaped braces for holding the upper ends of the two supporting tubes in between; and (7) a U-shaped pull handle telescopingly installed on the upper ends of the two supporting tubes.

8 Claims, 4 Drawing Sheets

INTERNAL FRAME FOR A WHEELED SUITCASE

This is a continuation-in-part application of a previous filed U.S. patent application Ser. No. 08/409,837, filed Mar. 27, 1995, now U.S. Pat. No. 5,560,459, which is a continuation-in-part application of a first filed U.S. patent application Ser. No. 08/371,401, now U.S. Pat. No. 5,588, 512, filed Jan. 1, 1995.

BACKGROUND OF THE INVENTION

1. Field of the Invention

This invention relates to a wheeled suitcase, and more particularly, to an internal frame for supporting the wheeled suitcase.

2. Description of the Prior Art

Wheeled suitcases are popular for traveling because they can easily be pulled rather than carried. In order to reduce the overall weight of suitcase, most wheeled suitcase use a light-weight internal frame with a layer of flexible material covered on its outside. In such design the internal frame becomes the most important component in supporting the structure of wheeled suitcase.

My U.S. patent application Ser. No. 08/409,837, entitled "Internal frame with a modular central frame for a wheeled suitcase", filed Mar. 27, 1995, discloses a modular central frame design. It shows an internal frame for supporting a wheeled suitcase which comprises a base, a U-shaped frame mounted on top of the base and a modular central frame comprising an L-shaped head set having an L-shaped brace and an extension board connected to the front end of the L-shaped brace, two rectangular tubes slidably connected to the lower end of the L-shaped brace, and two sockets connected to the lower ends of the two rectangular tubes. The upper end of the central frame is mounted to the top panel of the U-shaped frame and the lower end of the central frame is mounted to the rear end of the base so that the structure of the internal frame is greatly strengthened by the central frame.

SUMMARY OF THE INVENTION

In general, the invention features an improved internal frame for a wheeled suitcase. In a preferred embodiment, the present invention comprises an internal frame for supporting a substantially rectangular wheeled suitcase comprises:

(1) a base;

(2) a U-shaped frame having a top panel and two side panels, the lower ends of the two side panels being vertically mounted to the left and right sides of the base;

(3) a substantially rectangular extension board wherein the approximately middle section of the extension board is mounted to the top panel of the U-shaped frame;

(4) two L-shaped braces mounted on the rear end of the extension board;

(5) two supporting tubes vertically mounted on the rear side of the base;

(6) two L-shaped head covers mounted on the rear sides of the two L-shaped braces for holding the upper ends of the two supporting tubes in between; and (7) a U-shaped pull handle telescopingly installed on the upper ends of the two supporting tubes.

The present invention provides an improved internal frame design over my previous invention. It simplifies the L-shaped brace 30 of the previous application. The two new L-shaped braces 23 shown in FIGS. 2–3 of this invention are smaller and simpler than the previous one. The assembly process of a wheeled suitcase using the new internal frame is also easier because of the new L-shaped brace design. The supporting tube shown if FIG. 4 of the present invention can be stuck closer to the rear side of the wheeled suitcase, and thus can provide more usable space inside the wheeled suitcase.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
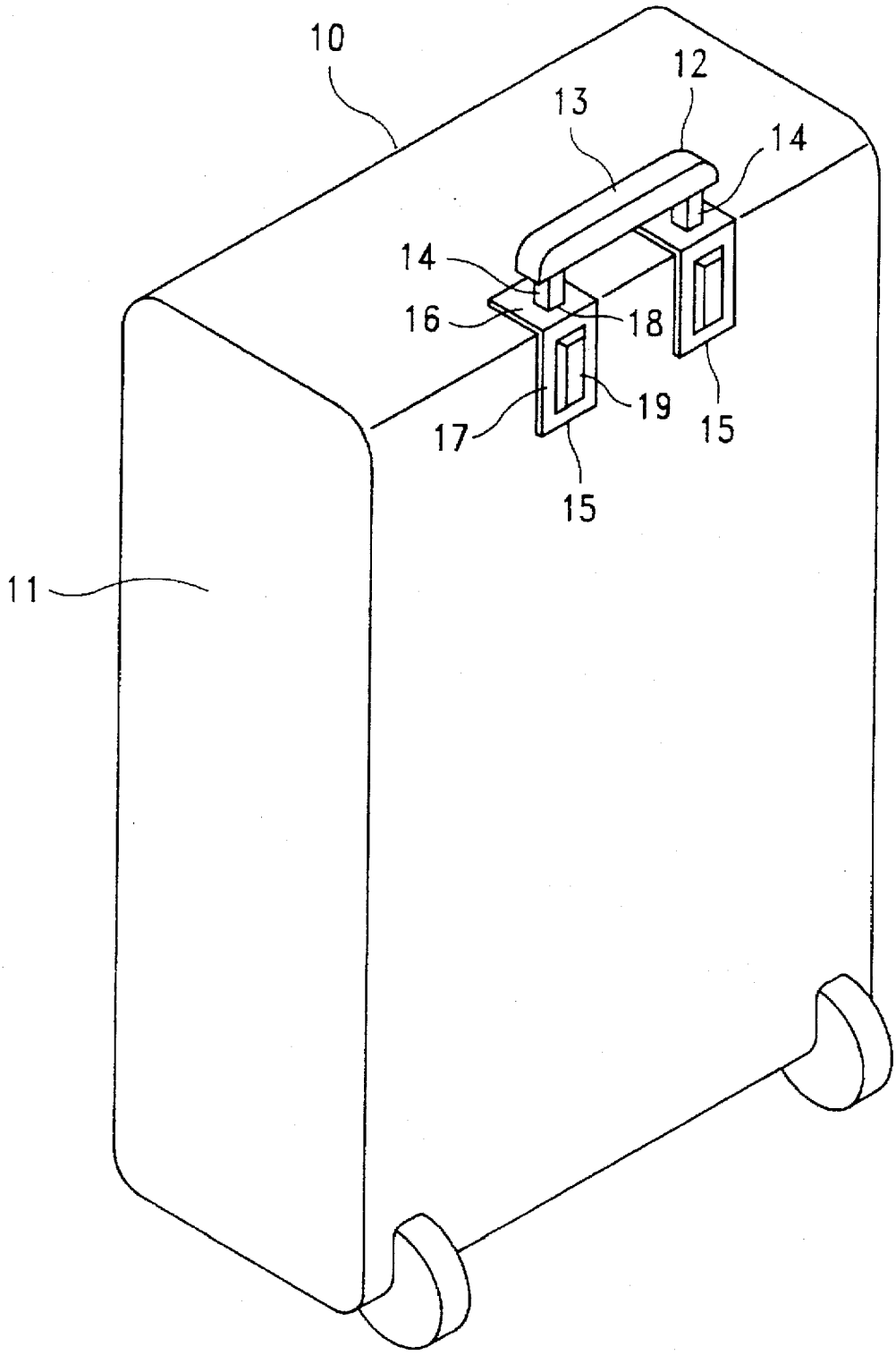
FIG. 1 is a perspective view of wheeled suitcase according to the present invention.

FIG. 1 is a perspective view of wheeled suitcase 10 according to the present invention. The wheeled suitcase 10 comprises a substantially rectangular suitcase body with a layer of flexible cover 11 as its outer layer, a U-shaped pull handle 12 located on the rear upper end of the wheeled suitcase 10 for pushing or pulling the wheeled suitcase 10 in forward or backward directions, and two L-shaped head covers 15. The pull handle 12 comprises a gripping handle 13 and two parallel rod members 14. Each of the two L-shaped head covers 15 comprises a top panel 16 and a rear panel 17. The top panel 16 of the L-shaped head cover 15 comprises a hole 18 for each of the rod members 14 to pass through. Each L-shaped head cover 15 further comprises a protruding skid 19 on the rear side of its rear panel 17 for protecting the rear upper end of the wheeled suitcase 10 when the rear end of the wheeled suitcase 10 is laid down horizontally on the ground.

Figure 2:
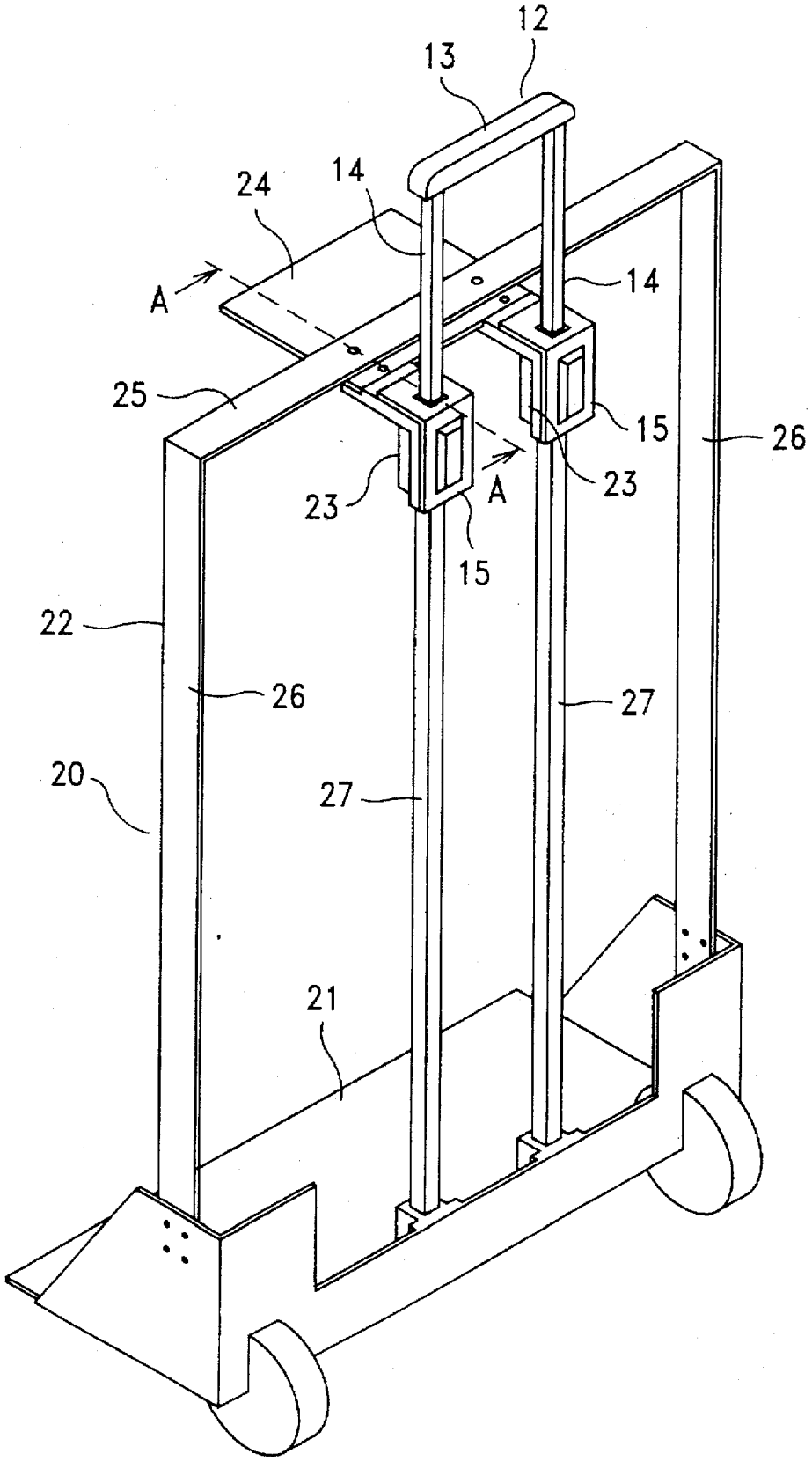
FIG. 2 is a perspective view of an internal frame for supporting the wheeled suitcase shown in FIG. 1.

FIG. 2 is a perspective view of an internal frame 20 for supporting the wheeled suitcase 10 shown in FIG. 1. The internal frame 20 comprises (1) a base 21, (2) a U-shaped frame 22 having a top panel 25 and two side panels 26, the lower ends of the two side panels 26 being vertically mounted to the left and right sides of the base 21, (3) a substantially rectangular extension board 24 wherein the approximately middle section of the extension board 24 is mounted to the top panel 25 of the U-shaped frame 22, (4) two L-shaped braces 23 mounted on the rear end of the extension board 24, (5) two elongated supporting tubes 27 vertically mounted on the rear side of the base 21, and (6) two L-shaped head covers 15 mounted on the rear sides of the two L-shaped braces 23 for holding the upper ends of the two supporting tubes 27 in between. The internal frame 20 further comprises a U-shaped pull handle 12 telescopingly installed on the upper ends of the two supporting tubes 27. The U-shaped pull handle 12 comprises a gripping handle 13 and two parallel rod members 14 wherein the lower ends of the two parallel rod members 14 are slidingly received by the upper ends of the two supporting tubes 27. The lower ends of the two supporting tubes 27 are vertically mounted to the rear side of the base 21, and the upper ends of the supporting tubes 27 are mounted between the L-shaped braces 23 and the L-shaped head covers 15. The approximately middle section of the extension board 24 is mounted under the top panel 25 of the U-shaped frame 22. The extension board 24 can be made by using some low cost material such as plywood. When the internal frame 20 is assembled into the wheeled suitcase 10 shown in FIG. 1, the flexible cover 11 will be clamped between the L-shaped braces 23 and the L-shaped head covers 15.

Figure 3:
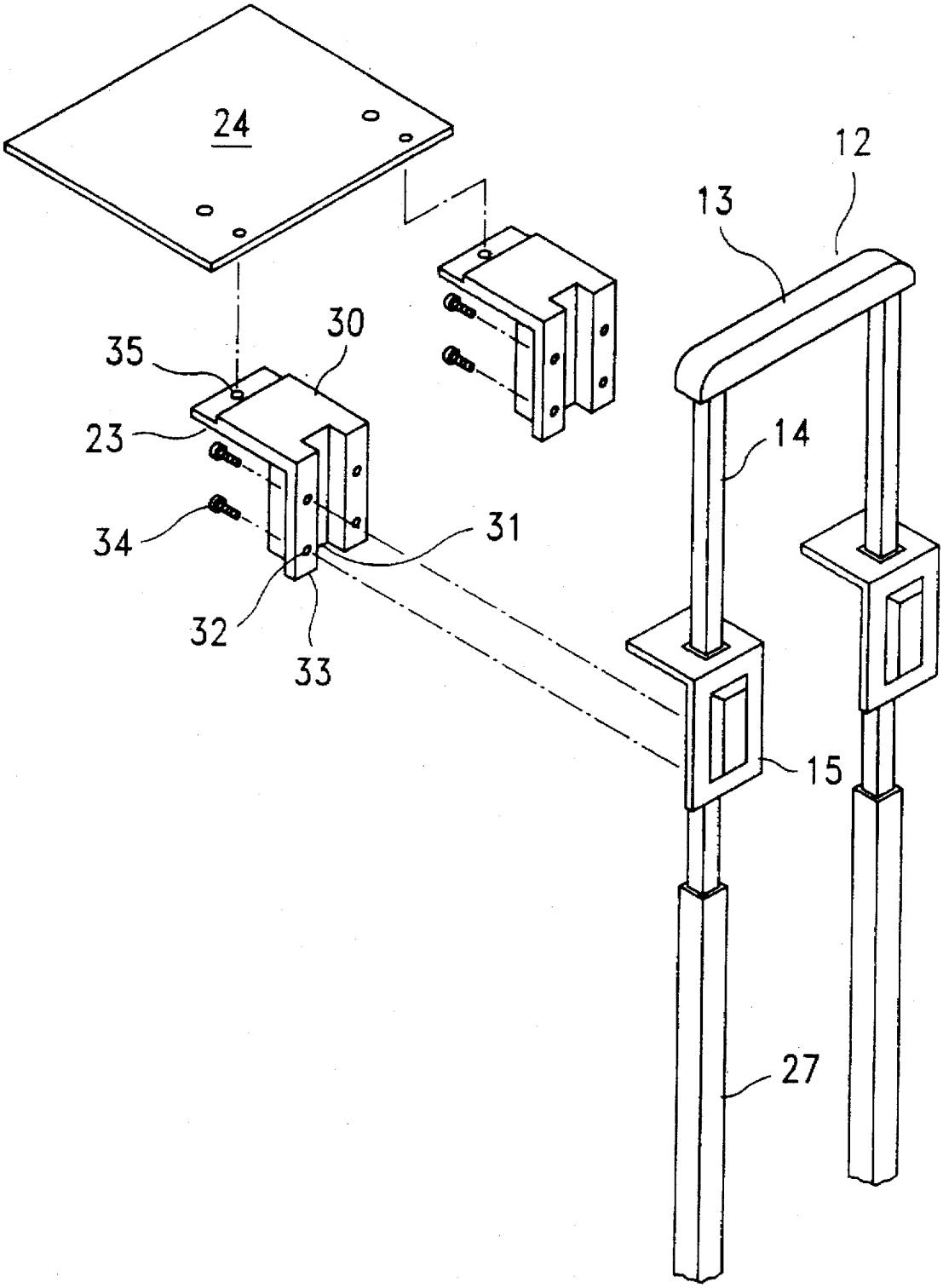
FIG. 3 is an exploded view of part of the internal frame shown in FIG. 2.

FIG. 3 is an exploded view of part of the internal frame 20 shown in FIG. 2. It shows the extension board 24, two L-shaped braces 23, and the retractable pull handle 12. The L-shaped head cover 15 is slidingly engaged with the rod member 14 between the gripping handle 13 and the upper end of the supporting tube 27. The L-shaped brace 23 comprises a top panel 30 and a U-shaped panel 31 vertically connected under the top panel 30. The front end of the top panel 30 comprises a mounting hole 35 for mounting rear end of the extension board 24. Each of the L-shaped braces 23 comprises a fastening means 34 which are four screws for fastening one correspondent L-shaped head cover 15. The L-shaped brace 23 and the L-shaped head cover 15 can be fastened together by using the four screws 34 through the screw mounting holes 32 over the two protruding edges 33 of the U-shaped panel 31. The U-shaped panel 31 is used for holding the upper end of the supporting tube 27. FIG. 2 shows that the upper end of one supporting tube 27 is held between the vertical U-shaped panel 31 of one L-shaped brace 23 and one correspondent L-shaped head cover 15 when the internal frame 20 is assembled.

Figure 4:
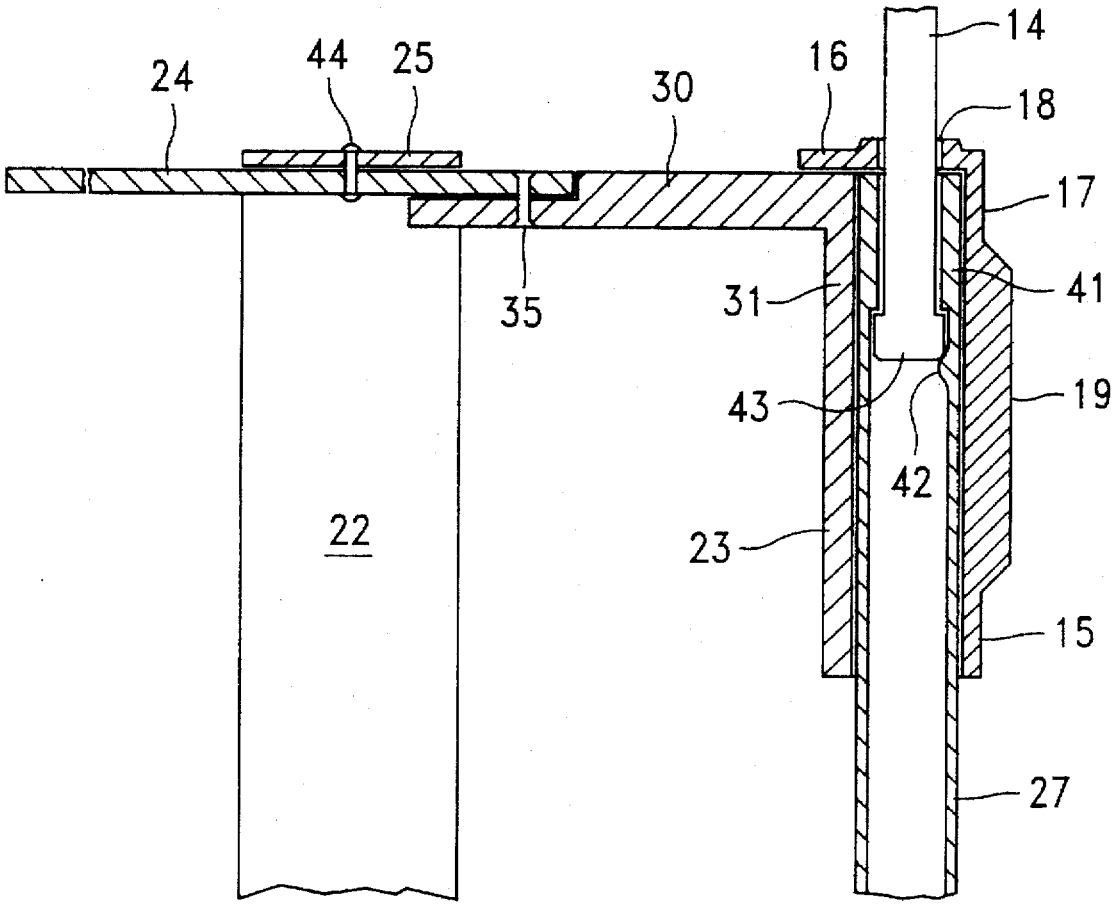
FIG. 4 is a sectional view A—A of FIG. 2.

FIG. 4 is a sectional view A—A of FIG. 2. It shows that the L-shaped brace 23 and the L-shaped head cover 15 are fastened together with the upper end of the supporting tube 27 held in between. The rod member 14 is telescopingly received by the supporting tube 27 through the opening 18 over the top panel 16 of the L-shaped head cover 15. The lower end of the rod member 14 comprises a rod guide 43 and the upper end of the supporting tube 27 comprises a rod stop 41 and also a rod detention 42 below the rod guide 43. The rod guide 43 is confined to the utmost position by the rod detention 42 when it is pulled up to the utmost position which is defined by the lower edge of the rod stop 41.

The L-shaped head cover 15 comprises a protruding skid 19 on the rear side of its rear panel 17 for protecting the rear upper end of the wheeled suitcase. The flexible cover 11 shown in FIG. 1 will be clamped between the L-shaped brace 23 and the L-shaped head cover 15 when the whole wheeled suitcase 10 is assembled. The rear end of the extension board is horizontally mounted to the mounting hole 35 over the front end of the top panel 30 of the L-shaped brace 23, and the approximately middle section of the extension board 24 is further mounted to the top panel 25 of the U-shaped frame 22 by using a fastener 44.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An internal frame for supporting a substantially rectangular wheeled suitcase comprising:

a base having a rear side;

a U-shaped frame having a top panel and two side panels, the lower ends of the two side panels being vertically mounted to the left and right sides of the base;

a substantially rectangular extension board having a rear end, the approximately middle section of the extension board is mounted to the top panel of the U-shaped frame;

two L-shaped braces mounted on the rear end of the extension board, each of the L-shaped braces comprising a top panel and a vertical U-shaped panel;

two elongated supporting tubes each having an upper end and a lower end, the lower ends of the two supporting tubes being vertically mounted on the rear side of the base, and the upper ends of the two supporting tubes being held in the vertical U-shaped panels of the two L-shaped braces; and two L-shaped head covers mounted on the two L-shaped braces, each of the L-shaped head covers comprising a top panel and a rear panel, the top panels of the two L-shaped head covers being attached to the top panels of the two L-shaped braces and the rear panels of the two L-shaped head covers being attached to the vertical U-shaped panels of the two L-shaped braces for holding the upper ends of the two supporting tubes in between;

wherein each of the upper ends of the two supporting tubes is held between the vertical U-shaped panel of one L-shaped brace and one correspondent L-shaped head cover.

2. The internal frame of claim 1 wherein the top panel of each L-shaped brace is mounted to the rear end of the extension board.

3. The internal frame of claim 1 wherein each of the L-shaped braces comprises a fastening means for fastening one correspondent L-shaped head cover.

4. The internal frame of claim 1 further comprising a U-shaped pull handle telescopingly installed on the upper ends of the two supporting tubes.

5. The internal frame of claim 1 wherein each L_shaped head cover further comprises a protruding skid on the rear side of its rear panel for protecting the rear upper end of the wheeled suitcase.

6. The internal frame of claim 1 wherein each of the supporting tubes is a substantially rectangular tube.

7. The internal frame of claim 1 wherein each of the rod members is a substantially rectangular rod.

8. The internal frame of claim 1 wherein the extension board is made of plywood.

* * * * *